US008726886B2

(12) United States Patent
Mason

(10) Patent No.: US 8,726,886 B2
(45) Date of Patent: May 20, 2014

(54) FUEL SUPPLY SYSTEM AND ANTI-SIPHON JET PUMP

(75) Inventor: Paul Mason, Dearborn, MI (US)

(73) Assignee: Robert Bosch GmbH, Stuttgart (DE)

( * ) Notice: Subject to any disclaimer, the term of this patent is extended or adjusted under 35 U.S.C. 154(b) by 351 days.

(21) Appl. No.: 13/216,772

(22) Filed: Aug. 24, 2011

(65) Prior Publication Data

US 2013/0047966 A1 Feb. 28, 2013

(51) Int. Cl.
*F02M 37/04* (2006.01)

(52) U.S. Cl.
USPC ..... 123/509; 417/76; 123/516

(58) Field of Classification Search
USPC ..... 123/509, 514, 516, 518–520, 198 D; 417/65–80, 151; 73/114.39
See application file for complete search history.

(56) References Cited

U.S. PATENT DOCUMENTS

| | | | | |
|---|---|---|---|---|
| 5,715,798 | A * | 2/1998 | Bacon et al. | 123/514 |
| 6,123,511 | A * | 9/2000 | Sertier | 417/87 |
| 6,283,142 | B1 | 9/2001 | Wheeler et al. | |
| 6,371,153 | B1 | 4/2002 | Fischerkeller et al. | |
| 6,457,945 | B2 * | 10/2002 | Kleppner et al. | 417/84 |
| 7,066,153 | B2 * | 6/2006 | Vitalis et al. | 123/514 |
| 7,216,633 | B2 * | 5/2007 | Attwood et al. | 123/509 |
| 7,234,451 | B2 | 6/2007 | Betz, II et al. | |
| 7,303,378 | B2 | 12/2007 | Kleppner et al. | |
| 7,370,640 | B2 * | 5/2008 | Dickenscheid | 123/510 |
| 7,441,545 | B1 * | 10/2008 | Fisher et al. | 123/467 |
| 7,444,990 | B1 * | 11/2008 | Fisher et al. | 123/459 |
| 7,571,716 | B2 | 8/2009 | Tipton et al. | |
| 7,658,181 | B2 | 2/2010 | Dickenscheid | |
| 8,459,960 | B2 * | 6/2013 | Mason et al. | 417/79 |
| 2002/0081211 | A1 * | 6/2002 | Benghezal et al. | 417/87 |
| 2007/0104589 | A1 * | 5/2007 | Marx | 417/87 |
| 2007/0217922 | A1 * | 9/2007 | Braun et al. | 417/198 |
| 2008/0190397 | A1 | 8/2008 | Tipton et al. | |
| 2008/0273992 | A1 * | 11/2008 | Killion | 417/185 |
| 2009/0252618 | A1 | 10/2009 | Gensert | |

(Continued)

FOREIGN PATENT DOCUMENTS

| | | |
|---|---|---|
| DE | 4336060 | 4/1995 |
| WO | 02/46598 | 6/2002 |
| WO | 2004/111427 | 12/2004 |

OTHER PUBLICATIONS

International Search Report and Written Opinion for Application No. PCT/US2012/051781 dated Nov. 7, 2012 (8 pages).

*Primary Examiner* — Thomas Moulis
*Assistant Examiner* — Joseph Dallo
(74) *Attorney, Agent, or Firm* — Michael Best & Friedrich LLP

(57) ABSTRACT

A fuel supply system includes a fuel supply pump and a jet pump utilizing flow from the supply pump to supply fuel to a fuel pump reservoir from a main fuel tank. The jet pump includes a body with a main inlet coupled to an outlet of the supply pump provided at its upper end. A nozzle is positioned on an interior of the body. A mixing tube is defined by the body downstream of the nozzle, and defines a channel extending along an axis. A suction inlet of the body is in fluid communication with the mixing tube channel. A jet pump outlet formed in the body is positioned at or above an upper portion of the reservoir such that fuel pours down into the reservoir. The body redirects fuel in a direction away from the axis for discharge through the jet pump outlet.

20 Claims, 2 Drawing Sheets

(56) References Cited

U.S. PATENT DOCUMENTS

| | | | | |
|---|---|---|---|---|
| 2009/0290994 | A1* | 11/2009 | Kieninger et al. | 417/198 |
| 2009/0304527 | A1* | 12/2009 | Wattai et al. | 417/151 |
| 2010/0202898 | A1 | 8/2010 | Mason et al. | |
| 2010/0290924 | A1* | 11/2010 | Becker et al. | 417/79 |
| 2010/0319793 | A1* | 12/2010 | Smid et al. | 137/565.22 |
| 2010/0332108 | A1 | 12/2010 | Kato et al. | |
| 2011/0000468 | A1* | 1/2011 | Malec et al. | 123/509 |
| 2011/0250079 | A1* | 10/2011 | Kim et al. | 417/198 |

* cited by examiner

FUEL SUPPLY SYSTEM AND ANTI-SIPHON JET PUMP

BACKGROUND

The present invention relates to jet pumps, which are commonly used to draw fuel from a main fuel tank chamber into a fuel pump reservoir to keep an adequate fuel supply in the fuel pump reservoir.

Fuel supply systems (sometimes called "fuel pump modules") with jet pumps are designed to create a low pressure suction area by pushing fuel through a nozzle with a fuel supply pump. The low pressure suction area of the jet pump is in communication with the fuel in the main fuel tank so that the fuel from the main fuel tank is drawn into the suction area of the jet pump, mixing with the fuel exiting the nozzle in a mixing tube. The outlet of the jet pump discharges into the fuel pump reservoir to maintain an adequate fuel level for the fuel pump to supply to the engine, especially in the event of excessive lateral g-forces or sloshing due to harsh road conditions which may otherwise starve the fuel pump. Because conventional jet pumps deliver fuel from the main fuel tank to the fuel pump reservoir, often at or near the bottom of the fuel pump reservoir, a flow path is established whereby fuel has the potential to siphon out of the fuel pump reservoir back into the main fuel tank when the fuel pump is turned off. This "dry" condition creates a problem for reliability as a lack of fuel in the fuel pump reservoir will hinder or completely prevent proper re-starting of the fuel pump and also the jet pump. Typically, the solution to prevent unwanted siphoning involves the addition of a check valve in the jet pump flow path between the main fuel tank to the fuel pump reservoir, so that fuel can only flow from the main fuel tank into the fuel pump reservoir and not vice versa. However, this presents the need for additional components and cost, and also can have a significant effect on the efficiency of the jet pump, whereby energy is wasted to overcome the resistance presented by the check valve.

SUMMARY

In one aspect, the invention provides a fuel supply system for delivering fuel from a tank to an engine of a motor vehicle. The fuel supply system includes a reservoir configured to be positioned within the tank, a supply pump, and a jet pump. The supply pump is positioned at least partially within the reservoir and includes an inlet positioned adjacent a bottom wall of the reservoir, and an outlet positioned above the inlet. The jet pump is coupled to the supply pump and configured to utilize a flow of pressurized fuel pumped from the reservoir by the supply pump to draw fuel from the tank and discharge fuel into the reservoir. The jet pump includes a body. A main inlet of the body is coupled to the outlet of the supply pump, and a nozzle is positioned on an interior of the body. A mixing tube is defined by the body downstream of the nozzle, and defines a channel extending along an axis. A suction inlet of the body is in fluid communication with the mixing tube channel. An outlet conduit of the body extends from the channel at least partially in a direction away from the axis, and an outlet of the body is positioned remotely from the channel along the outlet conduit. The outlet is positioned at or above an upper portion of the reservoir such that fuel pours down into the reservoir.

In another aspect, the invention provides a jet pump including a body, a main inlet of the body configured to receive a flow of pressurized fuel, and a nozzle positioned on an interior of the body in fluid communication with the main inlet and configured to receive the flow of pressurized fuel and to convert the flow from a high pressure, low velocity flow to a low pressure, high velocity flow. A mixing tube is defined by the body downstream of the nozzle and is configured to receive the low pressure, high velocity flow of fuel. The mixing tube defines a channel extending along an axis. A suction inlet of the body is in fluid communication with the mixing tube channel, and the suction inlet is configured to be fluidly coupled to a fuel source so that fuel from the fuel source can be drawn into the jet pump through the suction inlet by the pressure differential across the nozzle. An outlet conduit of the body protrudes outwardly from the mixing tube at least partially in a direction away from the axis. An outlet of the body is positioned remotely from the mixing tube channel along the outlet conduit.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
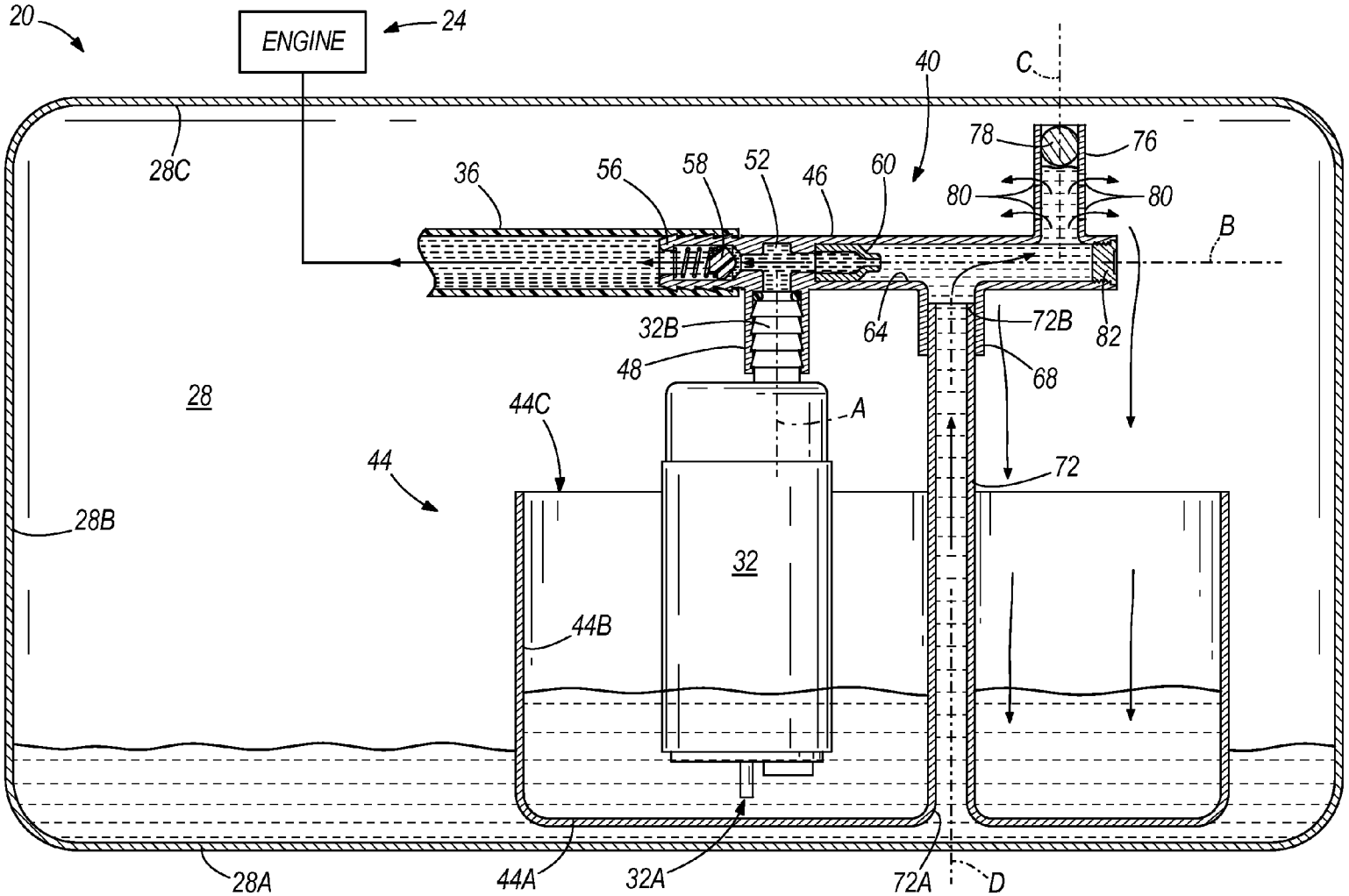
FIG. 1 is a cross-sectional view of a fuel supply system, including a fuel supply pump and a jet pump according to one construction of the invention.
Figure 2:
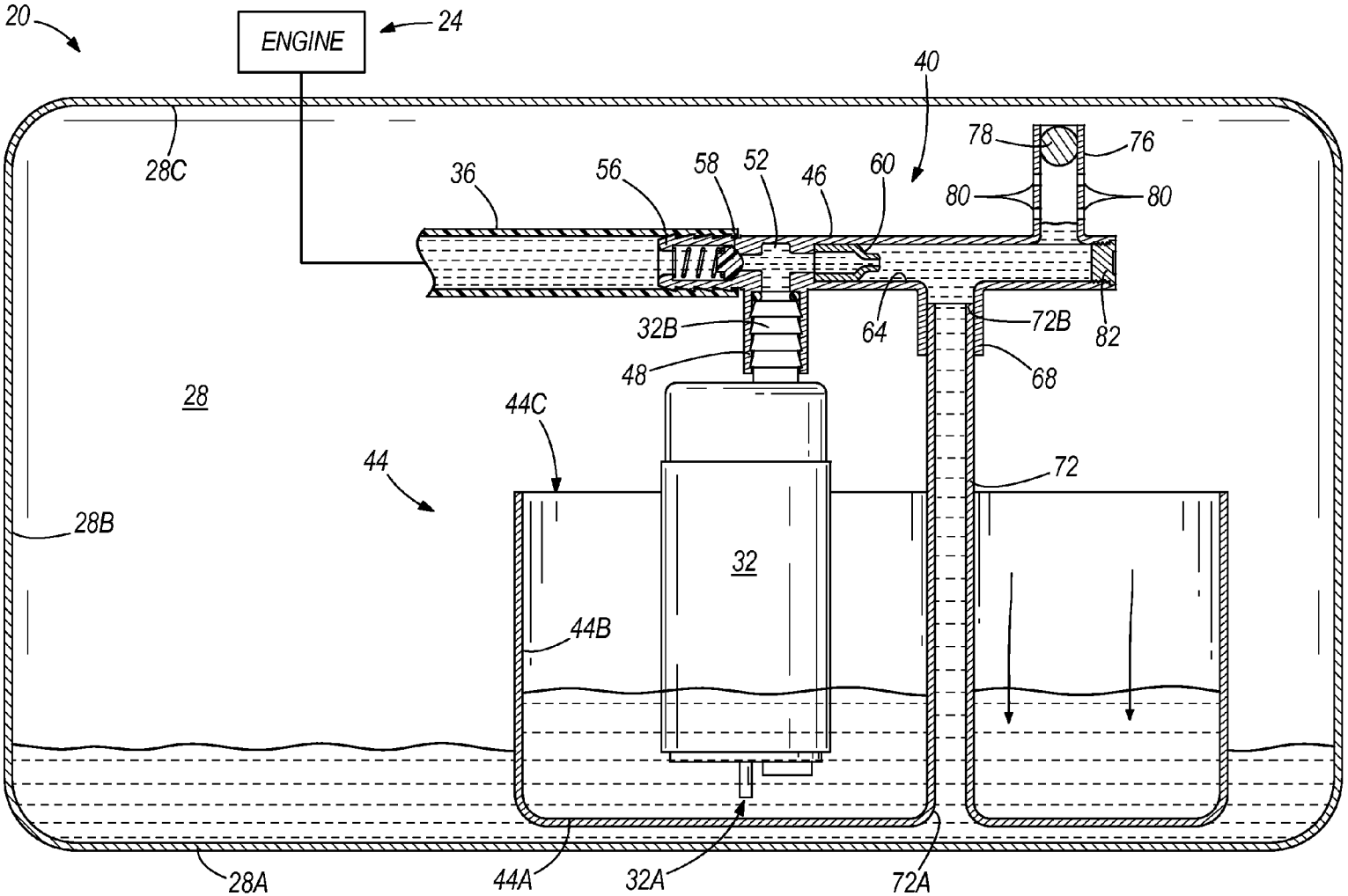
FIG. 2 is a cross-sectional view of the fuel supply system of FIG. 1, in an OFF state of the fuel supply pump.

FIGS. 1 and 2 illustrate a fuel supply system 20 for delivering fuel to an engine 24 (which may be in a motor vehicle for example) from a fuel tank 28. Although the engine 24 is schematically shown to represent any type of fuel-burning engine, it should also be appreciated that the invention is not necessarily limited by the type of engine 24 or other device that is supplied with fuel via the fuel supply system 20. As shown, the fuel tank 28 includes a bottom wall 28A, at least one sidewall 28B, and an upper wall 28C. The walls 28A-C of the fuel tank 28 define a substantially enclosed chamber for retaining a volume of fuel. A fuel fill spout and removable cap (not shown) may be provided to selectively provide access to the enclosed chamber to refill the fuel tank 28. The fuel supply system 20 further includes a fuel supply pump 32 positioned inside the fuel tank 28 and configured to be powered (e.g., electrically) to draw fuel from the fuel tank 28 and generate a pressurized flow of fuel that is supplied to the engine 24 via a fuel supply line 36. As such, the fuel supply pump 32 includes an inlet 32A and an outlet 32B. The inlet 32A is configured to be submerged in fuel, and when running, an internal pumping mechanism within the fuel supply pump 32 generates a pressurized flow of fuel from the outlet 32B, which is positioned at a height above the inlet 32A. In some embodiments, the outlet 32B is the sole outlet of the fuel supply pump 32.

As known in the art of vehicular fuel supply, the fuel supply system 20 is provided with a jet pump 40 to draw fuel from the fuel tank 28, which may be referred to as a "main" fuel tank defining a "main chamber", into a pump reservoir 44 from which the fuel supply pump 32 directly draws fuel. The pump reservoir 44 may be referred to as a "sub-chamber" within the main fuel tank 28. This arrangement provides a more consistent fuel level for the fuel supply pump 32 even when the overall fuel level is low or fuel in the main fuel tank 28 is subjected to excessive sloshing (e.g., caused by traversal of rough ground by a vehicle carrying the fuel supply system 20). The pump reservoir 44 includes a bottom wall 44A, at least one sidewall 44B, and may or may not include a top wall (not shown). The bottom wall 44A of the pump reservoir 44 is spaced just above the bottom wall 28A of the main fuel tank 28 (e.g., less than 20 mm). In the illustrated construction, the bottom wall 44A and the sidewall 44B of the pump reservoir 44 are integrally molded, and the sidewall 44B is substantially vertical. The top of the pump reservoir 44 is entirely open, and the top of the sidewall 44B defines a top edge 44C. As shown, at least a portion (including the inlet 32A) but not necessarily all of the fuel supply pump 32 is positioned within the pump reservoir 44. In general, the jet pump 40 utilizes the pressurized flow of fuel from the supply pump 32 to draw fuel from the area of the main fuel tank 28 (outside the pump reservoir 44) and discharge fuel into the pump reservoir 44. The jet pump 40 is described in further detail below.

The jet pump 40 includes a body 46. In some constructions, the body 46 is a unitarily molded (i.e., one-piece) plastic member formed with various inlets and outlets as described in further detail below. Although such a construction is preferable in some respects, other types of constructions, which may be of a metal or metal alloy, and/or consist of multiple pieces fitted together with joints, may alternately be employed for the body 46. The jet pump 40, and more particularly the jet pump body 46 of the illustrated construction, includes a main inlet 48 coupled with the outlet 32B of the fuel supply pump 32. In the illustrated construction, the main inlet 48 has a diameter sized to receive the fuel supply pump outlet 32B, which protrudes from the main body of the supply pump 32 and has external barbs for establishing a secure, fluid-tight connection with the main inlet 48 of the jet pump 40. The fuel supply pump outlet 32B and the jet pump main inlet 48 are both elongated about a common axis A. However, mechanically and fluidly coupling the outlet 32B of the fuel supply pump 32 and the main inlet 48 of the jet pump 40 may be accomplished by other structures and/or methods. When the outlet 32B is the sole outlet of the fuel supply pump 32, the jet pump main inlet 48 receives the entire flow of fuel and the full outlet pressure generated by the fuel supply pump 32. The main inlet 48 of the jet pump 40 is in fluid communication with an inlet chamber 52. The inlet chamber 52 receives the flow of pressurized fuel directed to the jet pump 40 from the fuel supply pump outlet 32B, and splits the flow into an engine supply flow and a jet pump-driving flow. The engine supply flow of fuel is directed to a jet pump outlet 56 that is configured to be physically and fluidly coupled with the fuel supply line 36 that delivers fuel to the engine 24. The outlet 56 is separated from the inlet chamber 52 by a check valve 58, which allows fuel to flow from the inlet chamber 52 to the outlet 56 and prevents fuel from returning to the inlet chamber 52 from the outlet 56 (e.g., upon stopping of the fuel supply pump 32).

The jet pump-driving flow of fuel is directed from the inlet chamber 52 to a nozzle 60 positioned inside the body 46. The nozzle 60 is arranged substantially on an opposite side of the inlet chamber 52 from the outlet 56 that feeds the supply line 36. Therefore, the inlet chamber 52 may function as a true "T-shaped" intersection, but other arrangements are also possible. A mixing tube is constituted by a portion of the body 46 downstream of the nozzle 60 which forms a channel 64 configured to receive both the flow of fuel from the nozzle 60 (i.e. fuel pumped by the supply pump 32) and fuel drawn into the jet pump 40 from the main fuel tank 28. The channel 64 extends along an axis B, which is substantially horizontal as shown. The nozzle 60 may also be centered about the axis B as shown. The flow of mixed fuel from the nozzle 60 traverses the channel 64 and is directed into an outlet conduit 76 of the jet pump 40. The outlet conduit 76, which may be integrally-formed as a single piece with the body 46, extends away from the channel 64 at least partially in a direction away from the channel axis B. In the illustrated construction, the outlet conduit 76 projects substantially vertically upwardly from the channel 64 along an axis C that is substantially perpendicular to the channel axis B (i.e., the outlet conduit 76 and the channel 64 are oriented at a 90 degree angle). A distal end of the outlet conduit 76 is plugged with a ball 78 or other means to prevent flow therethrough. One or more jet pump outlets 80 (four shown in FIGS. 1 and 2) are provided in the body 46, and more particularly, in the wall of the outlet conduit 76. Because the distal end of the mixing tube channel 64 is plugged with a threaded plug member 82 or other means, the entire flow of fuel through the mixing tube channel 64 is directed to the outlet conduit 76 and out of the jet pump 40 through the outlets 80. The outlets 80 in the outlet conduit 76 are positioned above the channel axis B, and more particularly, are positioned entirely above the channel 64. As discussed in further detail below, the outlets 80 are open-discharge type outlets (e.g., simple holes in the wall of the outlet conduit 76 in the illustrated construction) that freely release or discharge fuel from a location above the pump reservoir 44. In other words, the outlets 80 are in direct fluid communication with the surrounding environment (the main fuel tank volume), and are not coupled with any hoses, tubes, piping, etc. that lead to another location (i.e., into the pump reservoir 44). Although the jet pump outlet(s) are not limited to simple holes that freely discharge fuel directly from the outlet conduit 76, any conduit, piping, tubing, or flow director that directs fuel from the outlet conduit 76 into the pump reservoir 44 will terminate in an upper portion of the pump reservoir 44 or above the pump reservoir 44 so as not to extend into a lower portion of the pump reservoir 44.

Fuel drawn into the jet pump 40 from the main fuel tank 28 is admitted into the mixing tube channel 64 via a suction inlet 68. The suction inlet 68 can be integrally-formed as one piece with the body 46 in some constructions. The suction inlet 68 is physically and fluidly coupled with a suction tube 72. The suction inlet 68 can be positioned directly over the pump reservoir 44 such that the suction tube 72 can pass downwardly through the reservoir 44 to a suction location adjacent the bottom wall 28A of the main fuel tank 28, without establishing fluid communication between the suction inlet 68 and the pump reservoir 44. The suction tube 72 includes a first or inlet end 72A and a second or outlet end 72B. The inlet end 72A is positioned adjacent the bottom wall 28A of the main fuel tank 28 to the suction location. The outlet end 72B is coupled with the jet pump's suction inlet 68. In the illustrated construction, the suction inlet 68 and the suction tube 72 are substantially vertically-oriented about a common axis D, which is substantially perpendicular to the axis B of the mixing tube channel 64. Thus, the suction inlet axis D is substantially parallel to, but offset from, the direction in which the outlet conduit 76 extends from the channel 64. The entire suction flow passage defined between the channel 64 and the suction location (defined by the suction tube and the suction inlet in the illustrated construction, but not excluding the possibility of other additional elements), is non-check-valve-regulated. Whereas conventional jet pump suction flow passages typically require a check-valve to prevent fuel from siphoning out of the pump reservoir 44 back into the main fuel tank 28 upon the fuel supply pump 32 powering off, the present arrangement is automatically or inherently anti-siphoning as described in further detail below. As shown, the suction tube 72 can be integrally-formed as a single piece with the pump reservoir 44, or at least the bottom wall 44A thereof. By integrally-molding the pump reservoir 44 to include the suction tube 72, assembly is simplified, and a conduit is easily established between an area adjacent the bottom wall 28A of the main fuel tank 28 and the suction inlet 68 of the jet pump 40. Similarly, unitarily forming the body as a single piece (e.g., a single molded plastic piece) including at least the main inlet 48, the mixing tube defining the channel 64, the suction inlet 68, the outlet conduit 76, and the outlet(s) 80 greatly reduces overall assembly effort for the fuel supply system 20.

As mentioned briefly above, the jet pump outlets 80 formed in the outlet conduit 76 of the body 46 are open-discharge outlets that freely discharge fuel out of the jet pump 40. The outlets 80, and the jet pump 40 as a whole, are positioned above the pump reservoir 44 (or optionally in the upper portion of the pump reservoir 44) so that fuel is poured from the outlets 80 into the pump reservoir 44 as the supply pump 32 is operated. In some constructions, such as the illustrated construction, the outlets 80 can be positioned directly over the bottom wall 44A of the pump reservoir 44, at a height that is spaced above the bottom wall 44A (in some constructions, the outlets 80 are positioned at least above a mid-height of the pump reservoir 44). Because the nozzle 60 in the jet pump 40 converts fuel from a high pressure flow to a low pressure flow, the pressure of the fuel in the channel 64 and the outlet conduit 76 is relatively low. Although the nozzle 60 substantially increases the velocity of the flow of fuel, the velocity is reduced by the directional change from the axis B of the channel 64 to the axis C of the outlet conduit 76, and the low pressure of the fuel at the outlet conduit 76 ensures that the fuel flows from the outlets 80 without spraying outwardly. Thus, with the outlets 80 positioned directly over the pump reservoir 44, the fuel discharged from the jet pump 40 will trickle or pour freely into the pump reservoir 44. Even if the pressure in the outlet conduit 76 were increased to result in a slight amount of outward spraying from the outlets 80, the jet pump 40 can still be configured so that discharged fuel pours controllably down into the pump reservoir 44, either from directly above the pump reservoir 44 or from a slight lateral offset to account for an expected lateral component of the flow out of the outlets 80. Furthermore, the illustrated outlet conduit 76 can be modified to be provided with a flow-directing extension or one or more outlets 80 that face downwardly toward the pump reservoir 44 rather than facing substantially horizontally as shown in FIGS. 1 and 2.

When the fuel supply pump 32 is shut off (i.e., when a vehicle containing the fuel supply system 20 and the engine 24 is shut off), pressurized fuel supply to the main inlet 48 of the jet pump 40 is halted. Thus, flow through the nozzle 60 stops as does the suction action of fuel from the main tank 28 into the channel 64 through the suction tube 72. Because the channel 64 is in fluid communication with both the suction location at the bottom of the main fuel tank 28 and also the atmosphere (e.g., air) above the fuel level in the main fuel tank 28 (via the outlets 80), a fully-closed conduit is not established and fuel is automatically prevented from passively siphoning back out of the fuel pump reservoir 44 into the main fuel tank 28 through the suction tube 72. This eliminates the need for any check valve along the suction flow passage, which reduces complexity and cost without sacrificing anti-siphoning performance. In fact, performance can be improved over a suction flow passage having a check valve since the available suction pressure differential need not overcome the inherent flow resistance of a check valve.

Various features and advantages of the invention are set forth in the following claims.

What is claimed is:

1. A fuel supply system for delivering fuel from a tank to an engine of a motor vehicle, the fuel supply system comprising:

a reservoir configured to be positioned within the tank;

a supply pump positioned at least partially within the reservoir, the supply pump including an inlet positioned adjacent a bottom wall of the reservoir, and an outlet positioned at an upper end of the supply pump; and a jet pump coupled to the supply pump and configured to utilize a flow of pressurized fuel pumped from the reservoir by the supply pump to draw fuel from the tank and discharge fuel into the reservoir, the jet pump including a body, a main inlet of the body coupled to the outlet of the supply pump, the main inlet positioned closer to a top edge of the reservoir than a bottom wall of the reservoir, a nozzle positioned on an interior of the body, a mixing tube defined by the body downstream of the nozzle, the mixing tube defining a channel extending along an axis, a suction inlet of the body in fluid communication with the mixing tube channel, and an outlet formed in the body and positioned at or above an upper portion of the reservoir such that fuel pours down into the reservoir, wherein the body is configured to take fuel flowing along the axis through the channel and redirect the fuel in a direction away from the axis for discharge through the jet pump outlet.

2. The fuel supply system of claim 1, wherein the jet pump body further includes an inlet chamber adjacent the main inlet of the jet pump, and a second outlet in communication with the inlet chamber, the second outlet being configured to connect with a fuel supply line, and wherein the outlet of the supply pump that is coupled to the main inlet of the jet pump is the sole outlet of the supply pump.

3. The fuel supply system of claim 2, wherein the jet pump further includes a check valve positioned between the inlet chamber and the second outlet and configured to prevent flow of fuel from the second outlet into the inlet chamber.

4. The fuel supply system of claim 1, wherein the outlet of the jet pump is positioned directly over the reservoir.

5. The fuel supply system of claim 1, wherein an outlet conduit extends upwardly from the channel of the mixing tube at about a 90 degree angle with the axis.

6. The fuel supply system of claim 1, wherein the outlet of the jet pump is one of a plurality of outlets formed in an outlet conduit that extends in a direction away from the axis.

7. The fuel supply system of claim 1, wherein the suction inlet of the jet pump is positioned directly over the reservoir, the fuel supply system further comprising a suction tube coupled to the suction inlet and extending through the bottom wall of the reservoir to a suction location, without establishing fluid communication between the suction inlet and the reservoir.

8. The fuel supply system of claim 7, wherein a suction flow passage is defined between the mixing tube channel and the suction location at least in part by the suction tube and the suction inlet, and wherein the suction flow passage is non-check-valve-regulated.

9. The fuel supply system of claim 7, wherein the suction tube and the bottom wall of the reservoir are unitarily formed as a single piece.

10. The fuel supply system of claim 1, wherein the body is unitarily formed as a single piece with the main inlet, the mixing tube, the suction inlet, an outlet conduit extending away from the axis to the outlet, and the outlet.

11. The fuel supply system of claim 1, wherein the outlet is an open-discharge type outlet.

12. The fuel supply system of claim 1, wherein the outlet is spaced away from the channel along an outlet conduit extending from the channel at least partially in a direction away from the axis.

13. A jet pump comprising:

a body;

a main inlet of the body configured to receive a flow of pressurized fuel;

a nozzle positioned on an interior of the body in fluid communication with the main inlet and configured to receive the flow of pressurized fuel and to convert the flow from a high pressure, low velocity flow to a low pressure, high velocity flow;

a mixing tube defined by the body downstream of the nozzle and configured to receive the low pressure, high velocity flow of fuel, wherein the mixing tube defines a channel extending along an axis, and wherein a distal end of the mixing tube channel is closed to prevent flow from discharging axially from the channel;

a suction inlet of the body in fluid communication with the mixing tube channel, the suction inlet being configured to be fluidly coupled to a fuel source so that fuel from the fuel source can be drawn into the jet pump through the suction inlet by the pressure differential across the nozzle;

an outlet conduit of the body protruding outwardly from the mixing tube at least partially in a direction away from the axis; and an outlet of the body positioned remotely from the mixing tube channel along the outlet conduit.

14. The jet pump of claim 13, wherein the suction inlet defines an axis that is substantially parallel to and offset from the direction of protrusion of the outlet conduit from the channel.

15. The jet pump of claim 14, wherein the suction inlet and the outlet conduit are both located along the mixing tube channel on the same side of the nozzle.

16. The jet pump of claim 13, wherein the body is unitarily formed as a single piece with the main inlet, the mixing tube, the suction inlet, the outlet conduit, and the outlet.

17. The jet pump of claim 13, wherein the body further includes an inlet chamber adjacent the main inlet of the jet pump, and a second outlet in communication with the inlet chamber configured to be coupled with a fuel supply line.

18. The jet pump of claim 17, further comprising a check valve positioned between the inlet chamber and the second outlet and configured to prevent flow of fuel from the second outlet into the inlet chamber.

19. The jet pump of claim 13, wherein the outlet is an open-discharge type outlet configured to enable fuel to pour freely from the jet pump body.

20. The jet pump of claim 19, wherein the outlet is a hole in a wall of the outlet conduit.

* * * * *